US009943131B1

(12) United States Patent
Foust et al.

(10) Patent No.: US 9,943,131 B1
(45) Date of Patent: Apr. 17, 2018

(54) FOOTWEAR AIRFLOW SYSTEM

(71) Applicant: LaCrosse Footwear, Inc., Portland, OR (US)

(72) Inventors: Ryan James Foust, Portland, OR (US); Mark Christopher Thompson, Portland, OR (US)

(73) Assignee: LaCrosse Footwear, Inc., Portland, OR (US)

( * ) Notice: Subject to any disclaimer, the term of this patent is extended or adjusted under 35 U.S.C. 154(b) by 0 days.

(21) Appl. No.: 14/804,226

(22) Filed: Jul. 20, 2015

Related U.S. Application Data

(60) Provisional application No. 62/031,829, filed on Jul. 31, 2014.

(51) Int. Cl.
*A43B 7/08* (2006.01)
*A43B 17/08* (2006.01)

(52) U.S. Cl.
CPC ..... *A43B 7/081* (2013.01); *A43B 7/08* (2013.01); *A43B 7/087* (2013.01); *A43B 17/08* (2013.01)

(58) Field of Classification Search
CPC .. A43B 7/06; A43B 7/08; A43B 7/081; A43B 7/084; A43B 7/087; A43B 17/08
USPC ..... 36/3 R, 3 B, 147
See application file for complete search history.

(56) References Cited

U.S. PATENT DOCUMENTS 5,010,661 A * 4/1991 Chu ..... A43B 17/08 36/3 B
5,333,397 A * 8/1994 Hausch ..... A43B 17/08 36/3 B
5,675,914 A * 10/1997 Cintron ..... A43B 17/08 36/29
5,809,665 A * 9/1998 Suenaga ..... A43B 7/06 36/3 B
5,983,529 A * 11/1999 Serna ..... A43B 1/0072 36/28
6,092,305 A * 7/2000 Troy ..... A43B 1/0081 36/103
6,519,876 B1 * 2/2003 Geer ..... A43B 1/0081 36/102
6,931,763 B2 * 8/2005 Bray, Jr. ..... A43B 3/108 12/142 T
7,251,907 B1 * 8/2007 Bondarchuk ..... A43B 7/10 36/3 B
7,918,041 B2 * 4/2011 Cho ..... A43B 7/081 36/28

(Continued)

*Primary Examiner* — Sharon M Prange
(74) *Attorney, Agent, or Firm* — Perkins Coie LLP

(57) ABSTRACT

Footwear assembly comprising a foot bed in an interior area defined by an upper and positioned atop a sole assembly, wherein the foot bed has a plurality of air holes through the forefoot and/or arch portions, and has air channels connected to the air holes. A compressible convex pump in the foot bed's heel portion faces the sole assembly and is movable between expanded and compressed positions. In the expanded position, the pump supports a portion of the heel portion apart from the sole assembly to define an air chamber coupled to the air channels. Movement of the pump member from the expanded position to the compressed position causes the air chamber to collapse and forces air from the air chamber through the air channels and upwardly through the air holes into the interior area of the upper, wherein the pump member is biased toward the expanded position.

13 Claims, 5 Drawing Sheets

(56) References Cited

U.S. PATENT DOCUMENTS

| | | | | |
|---|---|---|---|---|
| 2006/0168846 | A1* | 8/2006 | Juan | A43B 17/08 36/3 B |
| 2010/0095553 | A1* | 4/2010 | Elnekaveh | A43B 1/0054 36/102 |
| 2011/0179672 | A1* | 7/2011 | Cheng | A43B 7/141 36/71 |
| 2012/0192452 | A1* | 8/2012 | Lewis | A43B 17/006 36/44 |
| 2014/0259756 | A1* | 9/2014 | Pan | A43B 7/087 36/43 |

* cited by examiner

FOOTWEAR AIRFLOW SYSTEM

CROSS REFERENCE TO RELATED APPLICATIONS

This non-provisional patent application claims the benefit of and priority to U.S. Provisional Patent Application No. 62/031,829, titled Footwear Airflow System, filed Jul. 31, 2014, and which is incorporated herein in its entirety by reference thereto.

TECHNICAL FIELD

The present invention is directed to footwear, and more specifically toward footwear having an airflow system for cooling.

BACKGROUND

Boots, such as hunting and hiking boots, are constructed with an upper connected to a sole assembly. The upper can be constructed from materials such as leather or synthetic materials, and the sole assembly can include a durable rubber outsole. Although these materials can protect and insulate a wearer's foot, they can be less breathable than materials used in other types of footwear. Accordingly, some boot materials can hold heat within the boot, which can lead to discomfort.

DETAILED DESCRIPTION

An airflow system for footwear is described in detail herein in accordance with embodiments of the present invention. Numerous specific details are set forth in the following description and figures to provide a thorough and enabling description of embodiments of the invention. One skilled in the relevant art, however, will recognize that the invention can be practiced without one or more of the specific details. In other instances, well-known structures or operations are not shown or are not described in detail to avoid obscuring aspects of the invention. In general, alternatives and alternate embodiments described herein are substantially similar to the previously described embodiments, and common elements are identified by the same reference numbers.

Figure 1A:
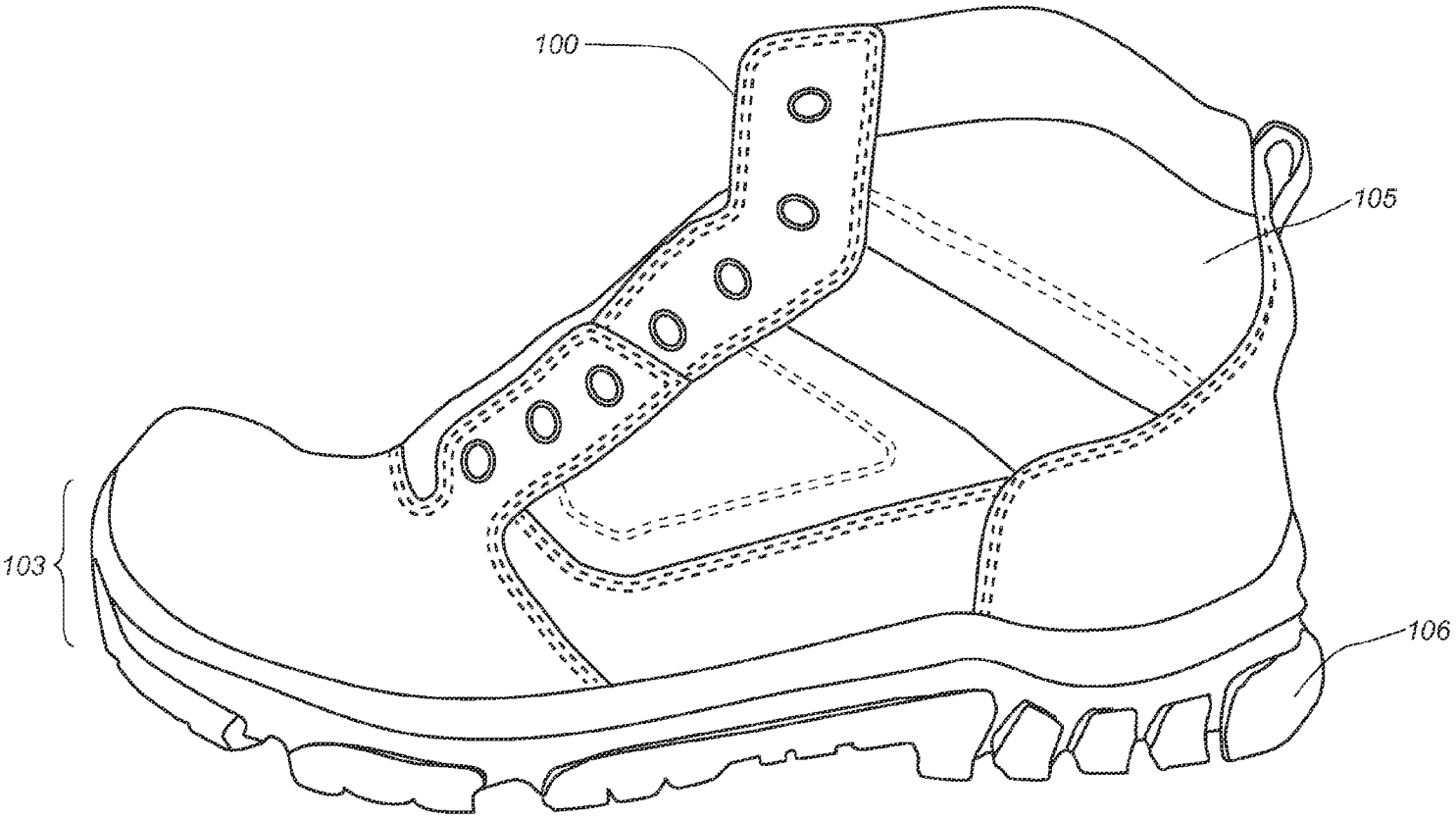
FIG. 1A is a side view.
Figure 1B:
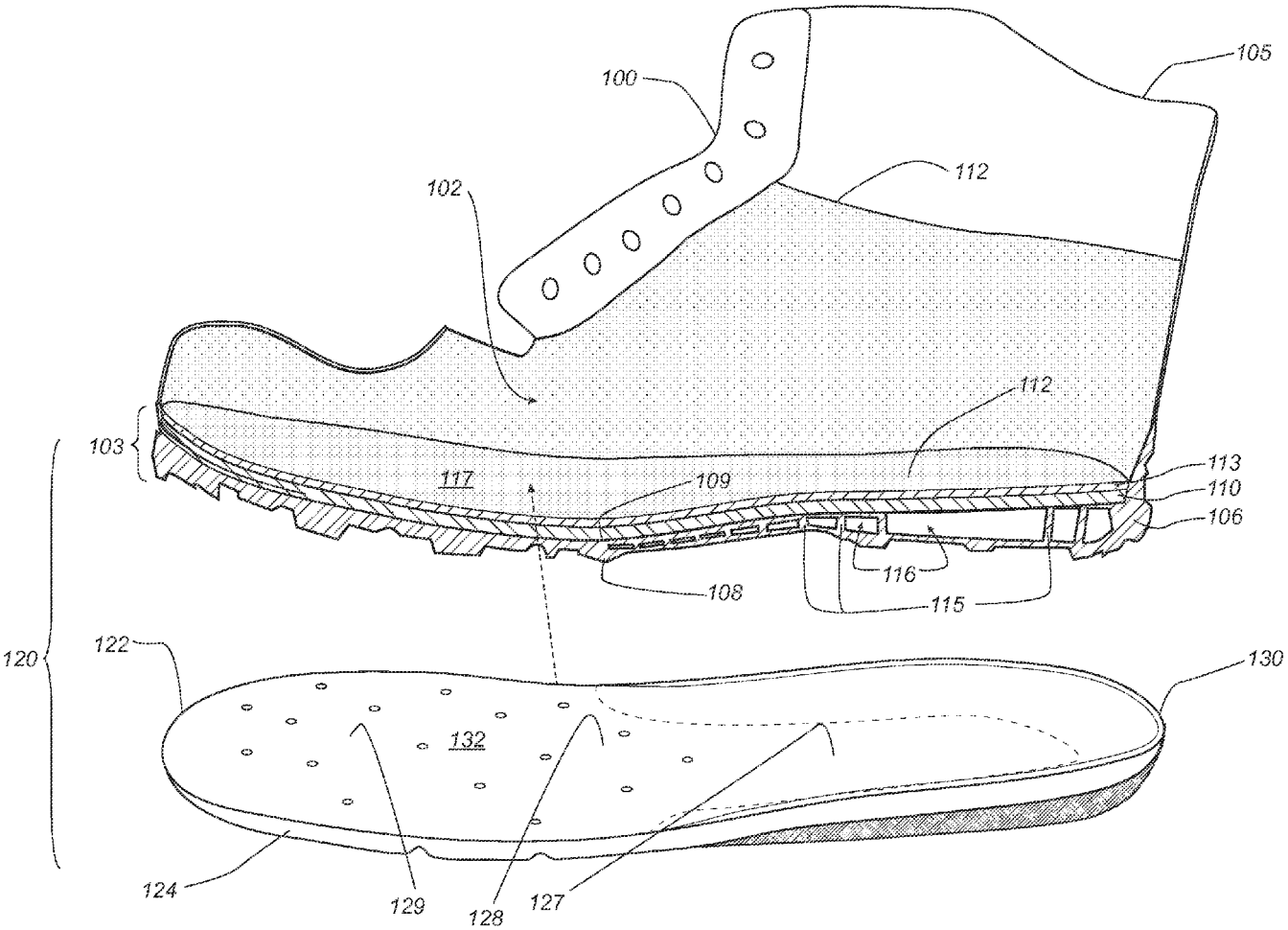
FIG. 1B is a partially-exploded, cross-sectional side view of a boot assembly having an internal airflow system configured in accordance with an embodiment of the disclosure.

FIG. 1A is a side view, and FIG. 1B is a partially-exploded, cross-sectional side view of a boot assembly 100 ("boot 100") having an internal airflow system 120 (FIG. 1B) configured in accordance with an embodiment of the disclosure. Referring to FIG. 1B, the airflow system 120 includes an integrated air flow footbed assembly 122 ("footbed assembly 122") removably positioned within an interior area 102 of the boot 100 that receives the foot of a wearer. The footbed assembly 122 is supported atop a sole assembly 103 in a position to engage and support the bottom of the wearer's foot. As described in greater detail below, the airflow system 120 is configured to promote movement of air (e.g., upward movement of air) through the footbed assembly 122 and around the interior area 102 to help cool and reduce perspiration of the wearer's foot during use. Although the airflow system 120 of the illustrated embodiment is described with reference to various aspects of the boot 100, airflow systems and airflow footbed assemblies configured in accordance with the various embodiments of the disclosure can be employed with shoes or other types of footwear.

As shown in FIG. 1B, the boot 100 includes an upper 105 securely connected to the sole assembly 103. The sole assembly 103 includes a sole structure 106 with a lower portion 108 that defines a durable outsole facing away from the upper 105 to engage the ground, and an upper portion 109 facing toward the upper 105. The sole assembly 103 of the illustrated embodiment includes a fairly stiff insole board 110 supported atop the sole structure's upper portion 109. In the illustrated embodiment, the upper 105 includes a bootie-style inner cloth liner 112 that extends underfoot above the insole board 110, and a thin insole pad 113 is positioned between the bottom of the cloth liner 112 and the top of the insole board 110. Although not shown in the illustrated embodiment for purposes of clarity, the sole assembly 103 can include other structures and features, such as a liner layer between the insole board 110 and the sole structure's upper portion 109, an internal or external shank or other stiffeners, and/or other intermediate layers between the sole structure 106 and the footbed assembly 122. Further, the boot 100 can also include other features not shown or labeled in the illustrated embodiments, such as other padding and/or a liner covering portions of the upper 105 or other interior regions of the boot 100.

The sole assembly 103 is constructed to provide a fairly stiff, low compression support structure under the wearer's foot, particularly in the heel and/or rear arch areas, against which the footbed assembly 122 can compress. In the illustrated embodiment, the sole structure's upper portion 109 of the sole structure 106 can be supported by rib features 115 extending from the sole structure's lower portion 108 and having hollow regions 116 disposed therebetween to reduce the weight and the amount of material used to form the sole structure 106. One or more embodiments can include individual rib features in the forefoot area of the sole structure 106 to further decrease weight while increasing flexibility underneath the wearer's forefoot during the later phases of the user's gait, such as the flat foot and toe-off phases.

Referring again FIG. 1B, the footbed assembly 122 is shaped and sized to removably fit within the boot's interior area 102 and atop an upper surface 117 of the stiff insole board 110, such that the footbed assembly 122 is fully supported by the stiff insole board 110 and the sole structure's upper portion 109. The footbed assembly 122 includes a full length, flexible and compressible midsole portion 124 having a heel region 127, an arch region 128, and a forefoot region 129 that support the heel, arch, and forefoot regions, respectively, of the wearer's foot. In one embodiment, the midsole portion 124 is made of a molded, closed-cell material of a selected thickness at the heel, arch, and forefoot regions 127-129, respectively, to provide a lightweight and durable structure with desirable cushioning and shock-absorbing characteristics. For example, the midsole portion 124 can be made from polyurethane (PU) or another suitable foam or lightweight compressible material with a thickness in the range of approximately 4-12 mm (e.g., 8 mm) in the forefoot region 129, approximately 4-12 mm (e.g., 10 mm) in the arch region 128, and approximately 8-20 mm (e.g., 15 mm) in the heel region 127. In the illustrated embodiment, an integral sidewall 130 surrounds the periphery of the heel region 127 to provide lateral stabilization and support for the wearer's heel. In some embodiments, a top surface 132 of the midsole portion 124 can include surface features (not shown) and/or be covered by a liner (e.g., a fabric liner) to reduce slippage and enhance traction between the footbed assembly 122 and the bottom side of the wearer's foot (e.g., a socked foot or a bare foot). The footbed assembly 122 can also be configured to have designs, patterns, text, logos, colors, or other features for aesthetic or other purposes.

In one aspect of this embodiment, the footbed assembly 122 is constructed of a partially compressible material (e.g., PU) having a selected thickness to provide the cushioning and shock absorption of a conventional midsole. As such, the sole assembly 103 does not require a separate compressible midsole attached to the sole structure 106, thereby allowing the boot 100 use less material and have less weight than conventional boot assemblies without sacrificing performance. Accordingly, methods of manufacturing the boot 100 can be less complicated and less expensive than those used to manufacture conventional boot assemblies. In other embodiments, however, the footbed assembly 122 can also be used with a different sole assembly that has an integrated midsole layer coupled to an outsole, while also providing the firm support surface or plate structure against which at least portions of the footbed assembly 122 can also be compressed during use of a boot or other type of footwear into which the footbed assembly 122 in inserted.

Figure 2:
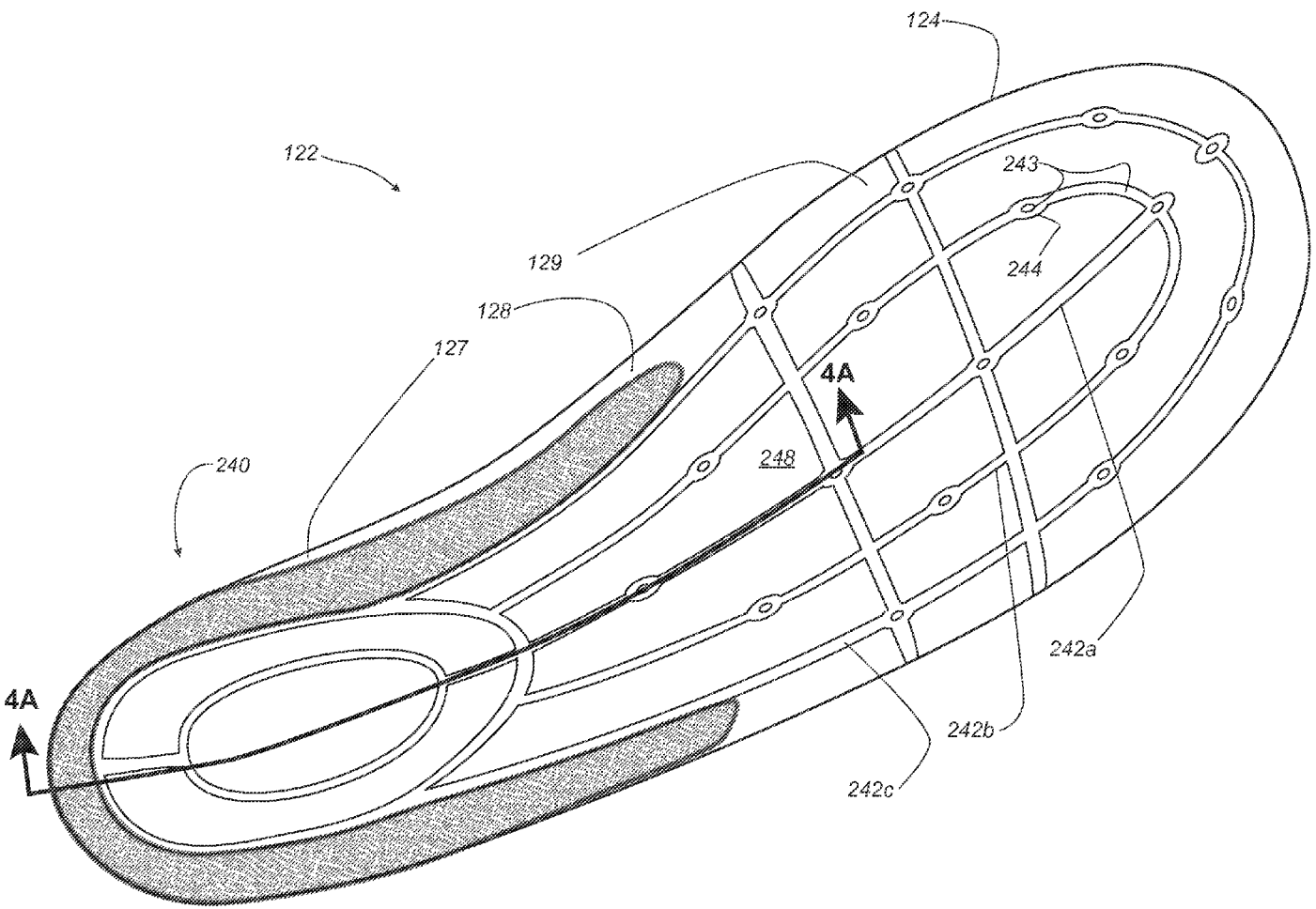
FIG. 2 is a bottom view showing a footbed assembly of the airflow system of FIGS. 1A and 1B in further detail.

FIG. 2 is a bottom view showing the footbed assembly 122 in further detail. As shown, the bottom of the footbed assembly's heel region 127 includes an integral, convex pump portion 240 and a plurality of air channels 242 (identified individually as first through third air channels 242*a*-242*c*) extending forwardly from the pump portion 240 through the arch region 128 and the forefoot region 129. In the illustrated embodiment, the air channels 242 are integrally formed in the bottom of the midsole portion 124. The air channels 242 are generally horizontally oriented and communicate with a plurality of apertures 243 extending through the footbed assembly to provide generally vertical air passageways that communicate with the boot's interior area 102. As described in greater detail below, the air channels 242 can direct output air from the pump portion 240 forwardly and into the apertures 243, which then direct the output air upwardly into the boot's interior area 102 (FIG. 1B).

Figure 3A:
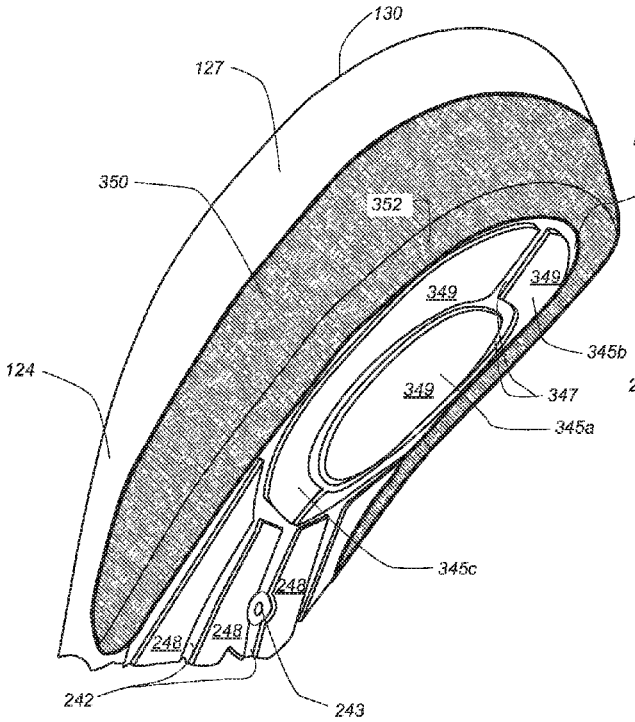
FIGS. 3A and 3B are rear isometric views showing an integral pump portion of the footbed assembly in further detail.
Figure 3B:
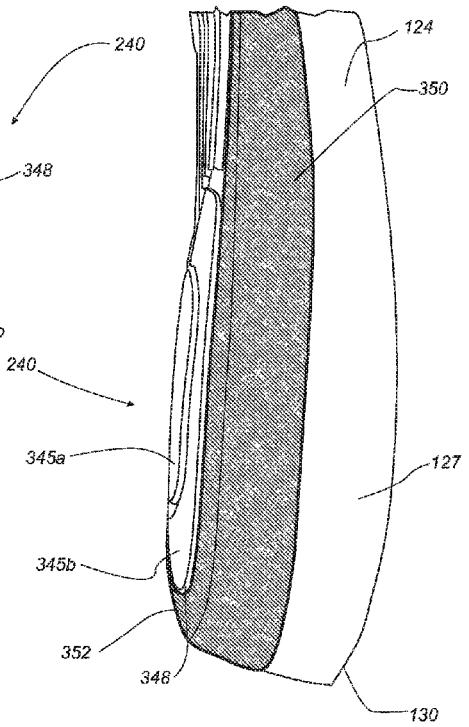

FIGS. 3A and 3B are rear isometric views of the footbed assembly 122 showing the pump portion 240 in further detail. Referring to FIGS. 3A and 3B together, the pump portion 240 includes a generally U-shaped and rigid heel collar 350 wrapping around the heel region 127 and surrounding integral, raised features, or pump pads 345 (identified individually as a central pump pad 345*a* and outer pump pads 345*b*-345*c*) formed in an underside surface 348 of the heel region 127. The heel collar 350 and the heel region 127 of the compressible midsole portion 124 define a concave partial cup-like area that receives, supports, and cradles the heel area of the wearer's foot. The heel collar 350 also provides a rigid support structure for the pump portion 240, and can be formed from a fairly stiff material, such as Thermo Plastic Urethane (TPU) or another suitable material, that is relatively stiffer than the material of the midsole portion 124. In the illustrated embodiment, the heel collar 350 is a separate structure that is attached to the heel region 127 below the sidewall 130, such as by an adhesive. In another embodiment, the heel collar 350 and the heel region 127 can be a unitary construction. For example, the heel collar 350 and the heel region 127 can be formed from a dual density material, with the heel collar 350 composed of a denser (i.e., stiffer) portion of the dual density material.

As shown in FIGS. 3A and 3B, the pump pads 345 project beyond a lower lip 352 of the heel collar 350, with the central pump pad 345*a* projecting a distance of approximately 1-4 mm (e.g., 2 mm) beyond the lower lip 352. The pump pads 345 also project beyond the first underside surface 248 of the midsole portion 124, and the pump pads 345 are separated from one another by breaks 347 in a second underside surface 349 of the pump portion 240 to facilitate airflow through the pump portion 240. In an unloaded condition or state, the center area of the central pump pad 345*a* engages the upper surface 117 of the stiff insole board 110, but the rest of the convex pump portion 240 and the heel collar 350 are supported away from the insole board's upper surface 117, thereby creating an air chamber 460 (FIG. 4A) under the heel area of the footbed assembly 122. In the illustrated embodiment, the heel collar 350 and/or the peripheral edge portions of the heel region 127 are shaped and sized to slidably engage the sidewalls 462 (FIG. 4A) of the upper's heel area to generally form a seal that blocks air in the air chamber 460 from freely flowing between the sides of the upper and the edges of the footbed assembly 122.

In operation, the pump portion 240 and the associated air chamber 460 (FIG. 4A) can be pumped by the wearer's heel while walking, running, or otherwise moving in a manner similar to a bellows and by alternatingly compressing and decompressing the pump portion 240 at the heel region 127. When the heel region 127 is in a compression stage, the outer pump pads 345*b*-*c* are pushed together with the central pump pad 345*a* into contact with the boot's underfoot surface 117 (FIG. 1B). As the heel region 127 moves toward the compression stage from the downward loads applied by the wearer's heel, the stiff, shaped heel collar 350 helps focus and laterally align the loads over the pump portion 240. For example, if a wearer's heel is laterally offset slightly during heel strike relative to the cup-like heel area of the footbed assembly, the stiff, heel collar 350 can help laterally guide the wearer's heel back into generally central alignment in the cup-like area and into better alignment over the pump portion 240 as the wearer's heel presses downwardly against the footbed assembly 122. Accordingly, as the air chamber collapses and the pump pads 345 are compressed and pressed into contact with the surface 117, they drive a volume of air from beneath the heel region 127 into the air channels 242 adjacent the pump portion 240.

When the heel region 127 is in a decompression stage, the outer pump pads 345*b*-*c* are lifted away from the underfoot surface 117 to expand the air chamber and draw air back beneath the heel region 127. In the illustrated embodiment, the pump portion 240 includes three pump pads, while in other embodiments, the pump portion 240 can have a different number of pump pads to achieve desired output air flow or pumping action. For example, the pump portion can include more than three pump pads (e.g., five pads) or less than three pump pads (e.g., two pads or one pad). Further, the pump portion 240 can include pump pads having different materials, shapes, or other types of features than shown in the illustrated embodiment. For example, the projection height of the pump pads 345 can be based on the size of the wearer's foot to accommodate relatively longer airflow channels in the midsole portion 124 for wearers with larger feet.

Referring again to FIG. 2, the air channels 242 are integral, open-faced channels formed in first underside surface 248 of the arch and forefoot regions 128-129. The air channels 242 can have a width of approximately 2-5 mm (e.g., 3 mm) and can extend into the underside surface by a depth of approximately 0.5-1.0 mm (e.g., 1.0 mm). In the illustrated embodiment, the first air channel 242*a* extends longitudinally from the pump portion 240 across the arch and forefoot regions 128-129, the second air channel 242*b* wraps around the first air channel 242*a*, and the third air channel 242*c* wraps around second air channel 242*b*. The air channels 242 can have various shapes, depths, widths, and/or patterns selected to deliver a suitable amount of the output air from the pump portion 240 to each of the apertures 243.

With reference still to FIG. 2, the apertures 243 are formed through the arch and forefoot regions 128-129, although the apertures 243 can also be formed in or near the heel region 127 to distribute output air toward the wearer's heel. The individual apertures 243 have a diameter of approximately 1-3 mm (e.g., 2 mm) and can be surrounded by a circular depression 244 having a concave surface that facilitates airflow between the apertures 243 and their corresponding air channels 242. The apertures 243 can selected to have any of a variety of diameters and/or hole shapes (e.g., circular-shapes, ovular-shapes, diamond-shapes, or others shapes) to achieve a desired amount of air flow and to distribute the output air evenly or at preferential locations around the wearer's foot.

Figure 4A:
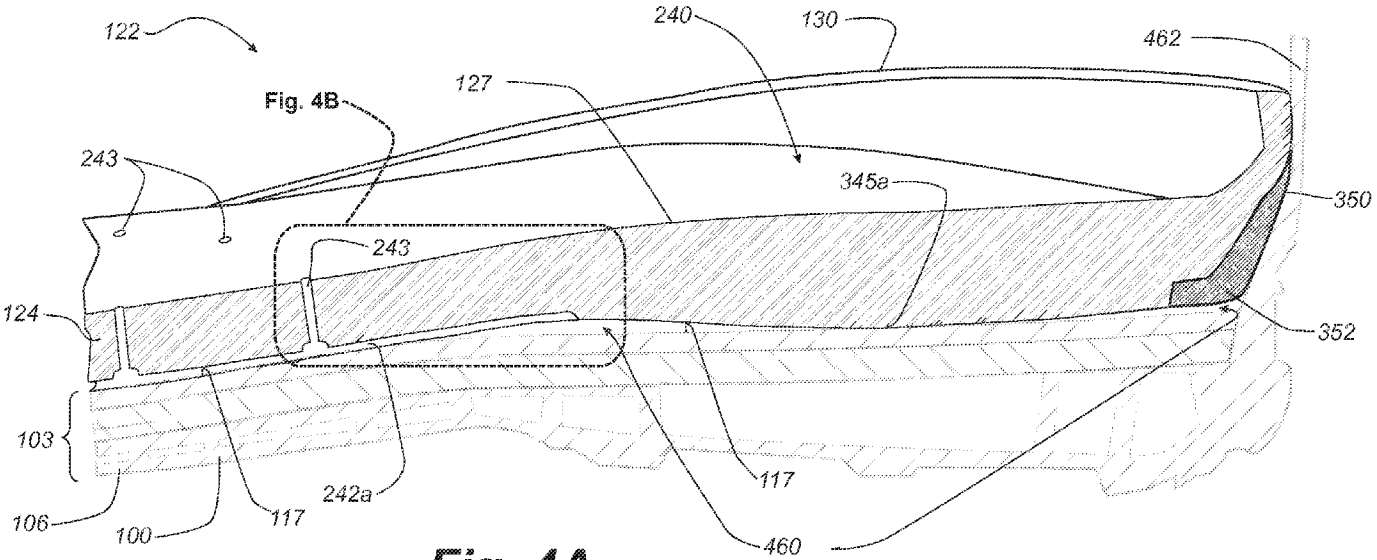
FIG. 4A is a partial cross-sectional side view taken along line 4A-4A of FIG. 2 showing the footbed assembly seated in the boot assembly and in a first operative stage.
Figure 4B:
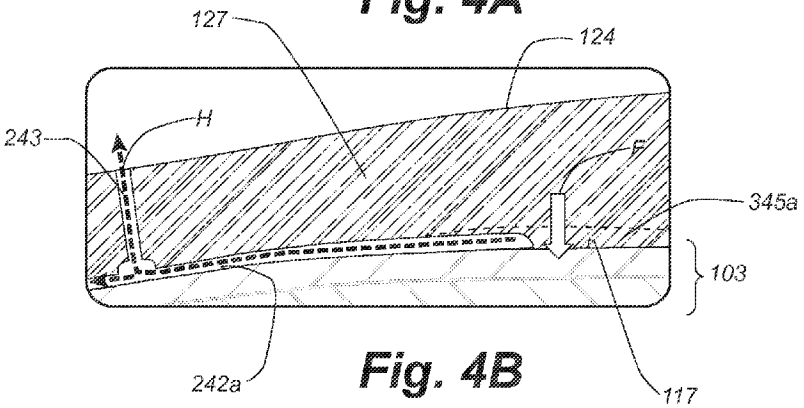
FIG. 4B is an enlarged view taken from FIG. 4A showing the pump portion in a second operative stage after the first operative stage.

FIG. 4A is a partial cross-sectional side view taken along line 4A-4A of FIG. 2 showing the footbed assembly 122 seated in the boot 100 and in a first operative stage, and FIG. 4B is an enlarged view taken from FIG. 4B showing the pump portion 240 in a second operative stage after the first operative stage. The operative stage of FIG. 4A can occur, for example, during the later phases of the user's gait, such as the flat foot and toe-off phases, while the operative stage of FIG. 4B can occur during an earlier phase, such as during the heel strike phase.

Referring to the operative stage shown FIG. 4A, the heel region 127 is decompressed, and the central pump pad 345*a* is generally lifting the heel collar 350 and the outer pump pads 345*b*-345*c* (not visible in FIG. 4A) off of the boot's underfoot surface 117 to form the air chamber 460 beneath the heel region 127. Accordingly, the air chamber 460 is loaded with a volume of air. In the operative stage of FIG. 4B, a wearer (not shown) has applied a downward heel force (represented by arrow F) on the heel region 127 and thereby compressed the heel region 127 against the underfoot surface 117. When the heel region 127 is compressed, the air chamber 460 is temporarily collapsed and the pump pads 345 drive the air (represented by arrow H) from the air chamber 460 (FIG. 4A) into the air channels 242 adjacent the pump portion 240. The output air H then flows upwardly into the apertures 243 and exits the apertures 243 into the boot's interior area 102 (FIG. 1B), where it flows around the wearer's foot to produce a cooling effect.

The stiff heel collar 350 (FIG. 4A) stabilizes the heel region 127 when pushed into contact with the underfoot surface 117. For example, when in contact with the underfoot surface 117, the heel collar's lower lip 352 (FIG. 4A) can push against the sole assembly 103 to help form a laterally sable heel cup configuration as the wearer's heel applies the increased loads during the heel strike phase. After the operative stage of FIG. 4B, such as during the early flat foot phase, the heel region 127 can begin to decompress with decreasing heel force. As the heel region 127 decompresses, the pump pads 345 will lift the heel region 127 and draw a partial vacuum in the air chamber 460 between the heel region 127 and the sole assembly 103. The partial vacuum can pull return air through the apertures 243 and into air channels 242 and/or through any gaps between the sidewalls of the boot 100 and the lateral and medial sides of the footbed assembly's arch and forefoot regions 128-129. This returned air can re-load the air chamber 460 (FIG. 4A), and the returned air can then be re-driven out of the air chamber 460 at another subsequent stage to continue cooling the wearer's foot. Accordingly, the footbed assembly 122 provides a continual cyclical pumping of cooling air flow into the boot's interior area with each step by the wearer, thereby providing a comfortable, cooling, drying environment in the boot for the wearer's foot.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

We claim:

1. A footwear assembly, comprising:

a sole assembly having an outsole portion and an opposing upper portion;

an upper connected to the sole assembly and defining an interior area configured to receive a foot of a wearer;

a generally U-shaped heel collar having a first stiffness;

a foot bed in the interior area and positioned atop the upper portion of the sole assembly, the foot bed having a second stiffness less than the first stiffness, and having a heel portion, a forefoot portion, an arch portion between the heel and forefoot portions, a top portion facing the interior area, and a bottom portion facing the sole assembly, the foot bed comprising:

a plurality of air holes in the forefoot portion and/or the arch portion, the air holes extending between the top and bottom portions and in communication with the interior area of the upper;

a plurality of air channels extending along the bottom portion of the foot bed and in fluid communication with the air holes;

the stiff, generally U-shaped heel collar positioned around a perimeter area of the heel portion and adjacent to sidewall portions of the upper adjacent to the foot bed;

a protruding, convex pump member in the heel portion, partially surrounded by the heel collar, and facing toward the upper portion of the sole assembly, the pump member being compressible under the weight of a wearer between an expanded position and a compressed position, the pump member in the expanded position supports the heel collar away from the upper portion of the sole assembly to define an air chamber radially outward of and around the pump portion adjacent to the sidewall portions of the upper and in fluid communication with the air channels, the pump member in the compressed position is positioned with the heel collar immediately adjacent to the upper portion of the sole assembly wherein the air chamber is collapsed, and wherein movement of the pump member from the expanded position to the compressed position causes the air chamber to collapse and forces air from the air chamber through the air channels and upwardly through the air holes into the interior area of the upper, wherein the pump member is biased toward the expanded position.

2. The footwear assembly of claim 1 wherein the heel collar extends around the heel portion and along opposing sides of the arch portion.

3. The footwear assembly of claim 1, further comprising a stiff insole board between the foot bed and the upper portion of the sole assembly.

4. The footwear assembly of claim 1 wherein the air channels are integrally formed in the bottom portion of the foot bed.

5. The footwear assembly of claim 1 wherein the foot bed is a unitary member made of a compressible, foam-based material.

6. The footwear assembly of claim 1 wherein the foot bed is a unitary member made of a compressible, polyurethane material.

7. The footwear assembly of claim 1 wherein the heel collar is adhered to the bottom portion of the foot bed.

8. A foot bed for use with a footwear assembly having a sole assembly having an outsole portion and an opposing upper portion, and an upper connected to the sole assembly and defining an interior area configured to receive a foot of a wearer, the foot bed configured to be positioned in the interior area and atop the upper portion of the sole assembly, the foot bed comprising:

a heel portion; a forefoot portion, an arch portion between the heel and forefoot portions, a top portion facing the interior area, and a bottom portion facing the sole assembly, the heel portion, forefoot portion, and arch portion being made of a first material with a first stiffness;

a plurality of air holes in the forefoot portion and/or the arch portion, the air holes extending between the top and bottom portions and configured to be in communication with the interior area of the upper;

a plurality of air channels extending along the bottom portion of the foot bed and in fluid communication with the air holes;

a generally U-shaped heel collar positioned around a perimeter area of the heel portion and configured to be adjacent to sidewall portions of the upper adjacent to the foot bed, the heel collar being made of a second material having a second stiffness greater than the first stiffness;

a protruding, convex pump member in the heel portion partially surrounded by the heel collar and configured to face toward the upper portion of the sole assembly, the pump member being compressible under the weight of a wearer between an expanded position and a compressed position, the pump member in the expanded position is configured to support the heel collar away from the upper portion of the sole assembly to define an air chamber radially outward of and around the pump portion adjacent to the sidewall portions of the upper and in fluid communication with the air channels, the pump member in the compressed position is configured to be positioned with the heel collar immediately adjacent to the upper portion of the sole assembly wherein the air chamber is collapsed, and wherein the pump member is configured to force air from the air chamber through the air channels and upwardly through the air holes into the interior area of the upper when the pump member moves from the expanded position to the compressed position, wherein the pump member is biased toward the expanded position.

9. The foot bed of claim 8 wherein the heel collar extends around the heel portion and along opposing sides of the arch portion.

10. The foot bed of claim 8 wherein the air channels are integrally formed in the bottom portion of the foot bed.

11. The foot bed of claim 8 wherein the foot bed is a unitary member made of a compressible, foam-based material.

12. The foot bed of claim 8 wherein the foot bed is a unitary member made of a compressible, polyurethane material.

13. The foot bed of claim 8 wherein the heel collar is adhered to the bottom portion of the foot bed.

* * * * *